United States Patent [19]

Kryczun et al.

[11] 4,073,646

[45] Feb. 14, 1978

[54] METHOD FOR THE THERMAL REFINEMENT OF GREATLY CONTAMINATED COPPER IN MOLTEN PHASE

[75] Inventors: Alfred Kryczun; Gerhard Melcher, both of Cologne, Germany

[73] Assignee: Klöckner-Humboldt-Deutz Aktiengesellschaft, Germany

[21] Appl. No.: 685,987

[22] Filed: May 13, 1976

[30] Foreign Application Priority Data

May 16, 1975 Germany ..... 2521830

[51] Int. Cl.[2] ..... C22B 15/00

[52] U.S. Cl. ..... 75/76; 75/72; 266/217

[58] Field of Search ..... 75/76, 59, 60, 72, 74; 266/217

[56] References Cited

U.S. PATENT DOCUMENTS

| | | | |
|---|---|---|---|
| 3,437,475 | 4/1969 | Themeus et al. | 75/76 |
| 3,627,510 | 12/1971 | Vogt et al. | 75/76 |
| 3,945,820 | 3/1976 | Brotzmann et al. | 75/60 |
| 3,990,890 | 11/1976 | Leroy | 75/76 |

*Primary Examiner*—Walter R. Satterfield
*Attorney, Agent, or Firm*—Hill, Gross, Simpson, Van Santen, Steadman, Chiara & Simpson

[57] ABSTRACT

Method and apparatus for the thermal refinement of contaminated copper in the molten phase wherein superimposed molten phases are formed in a treating vessel, the lower being the copper bearing material and the upper phase containing slag, and reactive gases are simultaneously injected into each of the molten phases.

6 Claims, 5 Drawing Figures

METHOD FOR THE THERMAL REFINEMENT OF GREATLY CONTAMINATED COPPER IN MOLTEN PHASE

The invention relates to a method for the thermal refinement of greatly contaminated copper in molten phase.

In addition, the invention relates to an apparatus for carrying out the method.

The problem serving as basis for the invention is apparent from the world-wide scarcity of raw material, which for example in the metal sector and particularly with copper leads more and more to recirculation of aged metal.

To the copper metallurgical or smelting plants in this way there comes an increasing offer of greatly contaminated complex concentrates and secondary products such as waste metal scrap, ashes, slags, etc. Through a greater portion of such starting materials — even if also only a part — there occurs upon the smelting a raw copper, whose refinement to the anode quality according to the previous processing procedures is in many cases uneconomical, however, also problematic.

Then, upon the oxidation of blister-copper to copper matte or metal in converters of known type of construction such as Pearce Smith or Hoboken, on account of greater affinity to oxygen, sulphur and iron are preferably removed, while for example, lead, arsenic, antimony are only incompletely volatilized or sintered.

With relatively low contents of such impurities in the ore concentrate, their admixture remnants were economically and metallurgically of minor importance.

It is different upon the blasting of greatly contaminated black-copper, for example in Pearce-Smith Converters. The black-copper produced from the copper-containing scrap, slags, ashes and waste metal contains iron, zinc, lead and tin up to contents of totally more than 30%. In the refining process, these impurities are likewise oxidized by means of air-oxygen. The process may in this connection be carried out in two variations. In the one place, the oxidized accompanying metals are collected in a slag which represents a metallurgical intermediary product, — in the second place, through addition of coke or cinders, the metal oxides contained in the slag may be reduced to low-value more easily volatile oxides or to metals. This latter method-variation or -modification is known under the concept "Knudsen-process."

In any case, the degree of volatilization with this modus operandi is very unsatisfactory, and the adjustment of the reduction potential in the slag required for the volatilization operation — during prevention of a return-reduction of the oxidized/accompanying metals in the copper-bath — in the case of the modus operandi carried out at the present time in practice becomes practically impossible. It is therefore, even with the "Knudsen Process" necessary toward the end of the blasting operation, to work purely oxidizingly, in order to lower as far as possible the content of the contaminating accompanying metals in the copper bath. In this connection, it is unavoidable, because some of the accompanying metals, chiefly lead and tin, — are very similar to copper in behavior upon oxidation, and the high contents of these impurities in the copper bath may be blasted down only through a very intensive oxidation process for the requirements of a subsequent electrolytic refinement, — that a great part of the copper is oxidized in undesired manner to cuprous oxide.

And still, the contents of impurities in this converter-copper as a rule are still so high, that such converter-copper alone cannot economically be refined to anode quality for the refining-electrolysis.

It is therefore in many cases blended or mixed with more pure blister-copper and copper-scrap and first then refined thermally to anode-quality. This indeed results in a metallurgically utilizable method, is, however, highly uneconomical. As also for this purpose, the oxidation process must be carried out very far. In this connection, the necessary oxygen-transport takes place through concentration-diffusion, and the refining process therefore requires a relatively long period of time.

If the impurities in the copper-melt are too high, as for example with converter-copper or blister-copper from complex concentrates, then the thermal refining of this copper to anode quality in conventional anode-furnaces is completely uneconomical in the case of the previous modus operandi, and indeed for the one part, on account of the refining time to be expended, and for the other part, through increased copper slagging or sintering, as through too slow concentration diffusion, the removal of the oxygen in the copper melt out of the area of the air-inflating- or air-injection-zones, respectively, takes place too slowy, — which leads to over-oxidation of the copper and formation of a second molten phase in form of a cuprous oxide.

It is the object of the invention to furnish a method, and for this method an apparatus which enables it to convert greatly contaminated black-copper or copper-matte or -metal in the shortest possible time by economical means in only one aggregate into a copper with a degree of purity, which corresponds to the requirements for anode quality.

This is attained according to the invention thereby, that the molten material is treated with reaction gases in one processing chamber simultaneously in two reaction-phases lying spatially superimposed.

In this connection, it may be of advantage, that the reaction gases may be injected into each of the reaction phases with flow rates adjustable independently of one another.

With a purposeful embodiment of the invention, it may be of particular importance for the economical side of the refining method, that the reaction gases have in each of the reaction horizons a different chemical or stoichiometric composition. In this connection, one may for the purpose proceed so that the composition of a reaction medium is altered in the timewise course of the refining process.

This may, for example, occur in the manner, that the composition of at least one reaction medium in the timewise course of the refining process is altered to such a degree, that in the border layer metal/slag or directly above the metal bath, a gas atmosphere is set up, in which the ratio of partial pressures P ($CO_2$) to P (CO) has a logarithm in the range from $-0.3$ to $+4$.

Because finally the molten-bath-analysis constantly alters with the refining process, it may be to the purpose, that at the same time, an oxidizing reaction medium is injected into the lower reaction phase, and into the upper reaction phase, a reducing reaction medium.

In order to attain this, advantageously use may be made of the measure, known per se, that a reaction medium consists of a gas with a portion of liquid or solid fuel.

It may, however, also be of advantage together with the foregoing measures or in itself alone, if the procedure is so, that the gas-mass velocity of the upper reaction phase is adjusted to the gas-mass velocity of the lower phase in a determined ratio to one another, preferably 1:6.

Of importance in the sense of the invention, is with all of these measures, that of the reaction phases at least one is laid below the metal/slag interface and at least one other in the interface or closely above this interface. And finally, it was found of advantage in the case of the method according to the invention, that the mass velocity of a single gas-injection-point lies below 500 $Nm^3/h$.

For the closed circuit showing and basis of the method according to the invention, the course of the new reaction process is described on the basis of practical test results as follows:

The copper matte or metal tapped out of an ore-reverberatory furnace, suspension-smelting-furnace or electro-furnace is poured into a converter-vessel and brought therein to such a level that in the first phase of the iron- and sulphur-oxidation, the injection height or level of both reaction phases lies below the level of the bath. In this connection, there results an extraordinarily lively oxygen-transport, both through concentration-diffusion in the two blast- or smelting-planes as well as also through a high degree of bath-convection. In the course of this blasting or smelting phase, on account of the increasing density of the sulphide-smelt upon the conversion of the copper-matte or -metal to the refined garnierite for gaining copper of the bath level, the sulphide-smelt consisting of copper- and sulphide-sulphur, drops down and it forms on the sulphide bath a fayalite-slag with a high proportion of magnetite.

With the dropping of the blast- or smelt-level, the upper blast-horizon, however, also moves relatively to the smelting bath in the resultant layer of slag. Both the chemical composition of the copper-matte or -metal as well as also the injected quantity of air or oxygen permit of determining by calculation the point of time at which the upper blast-horizon will have reached the separating-plane or -level refined garnierite for gaining copper/slag. At this point of time, there is added to the reaction gas of the upper blast horizon, fuel, for example fine coal as reducing medium. At the same time, the reaction gas of the lower blast-horizon may be adjusted for example by means of admixture of oxygen, so as to be more greatly oxidizing. The dosaging of fuel, on the one hand, and oxygen, on the other hand, as well as the determination of the density of blast-flow of each reaction horizon result now from calculation, observation, test analyses and experience, — are, however, on account of the conditions defined according to the invention of a reproduceable control of the course of the process accessible according to a previously determined program. In order, for example, during the injection of copper-matte or -metal into the slag, to attain a sufficient magnetite reduction, thereupon, however, to prevent the formation of copper slag through excess oxidation to cuprous oxide, coal is added to the quantity of air blown into the layer of slag, in such quantity that in the slag a reducing reaction atmosphere results. This measure makes it possible to treat the copper bath greatly oxidizingly, so that also the elements coming close to copper in their oxygen-affinity are oxidized and conveyed into the slag layer. For the reducing atmosphere set up in the layer of slag, according to the type of impurities in the copper takes effect in such manner, that the oxides formed in the accompanying elements disturbing the copper are stable, while the undesired cuprous oxide also formed is again in a great measure reduced to metal. With the invention, it is in this manner possible for the first time to attain a high degree of refinement with only low copper-slagging or -sintering in comparison with the conventional thermal copper-refining. With this method, accordingly, from greatly contaminated copper-matte or -metal, a converter slag low in magnetite as well as a blister-copper may be injected, which directly in the same reaction vessel may be refined in a blasting operation connected in series to a copper with anode quality upon relatively great production of copper.

The same refining operation may be undertaken both with black copper produced in the converter as well as also with black copper produced in blast furnaces or in other melting aggregates, whereby the black copper may be added in liquid state or solid state into the converter. The oxygen-containing copper contained in the reaction vessel may be deoxidized in the reaction vessel itself, preferably, however, also in a polar furnace provided extra for the purpose, which at the same time is installed as founding furnace.

As an example, the blasting of a black copper is to serve, whose analysis could also stand for a blister-copper blasted out of contaminated copper-matte or -metal. The black copper coming from a residue-blast-furnace becomes liquid or molten in a Pearce-Smith-Converter, for example, with dimensions 3 m × 5 m, and when duly blasted. In the case of this converter-operation, value was attributed to the fact, — namely, to refine the copper to anode-quality and to recover the zinc, tin and lead contained in the black copper so far as possible as mixed oxide. For the adjustment of the reducing conditions in the slag-layer, a mixture of air was injected with coke-granulate. The proportion of coke was so regulated, that in the first phase of the blasting, a strongly reducing atmosphere was present in the slag. The logarithm of the partial pressure ratios in the converter atmosphere amounted during this blasting phase to logarithm P ($CO_2$) to P (CO) = about −0.3. This was determined through taking and analysis of gas-tests above the converter bath.

The starting product was a compound mixture of cooler-scrap and black-copper with the following composition:

Black copper charge = 19,600 kg
Cooler scrap charge = 1,800 kg.

Analyses

Black copper:
copper = 88.1%
tin = 2.6%
lead = 1.8%
zinc = 2.6%
remainder about 4% = iron, nickel, etc.

Cooler scrap:
copper = 64.9%
tin = 3.3%
lead = 9.2%
zinc = 22.6%

At the beginning of the blasting operation principally the zinc contained in the slag, oxidized out of the copper bath was reduced and volatilized. Upon continuing dezincking, the addition of coke to the air in the slag layer was decreased pro rata temporis, so that subsequently the largest part of the tin-proportion could be volatilized as SnO, upon prevention of oxidation of SnO to $SnO_2$. Thereafter, the blasting atmosphere was almost neutrally adjusted through still further decrease of coke. The partial-pressure-ratio of P ($CO_2$) to P (CO) in the converter atmosphere amounted in this connection to logarithm 4. In this blasting phase, the oxidation took place of lead to PbO during partial volatilization of the same. By means of maintenance of the more or less reducing atmosphere, approximately at the interface of copper-slag, an overoxidation of the copper was limited. With these blasting operations, the blasting quantities per nozzle recognized as optimum for carrying out of the method according to the invention, served as basis with max. 500 $Nm^3/h$.

With this quantity of air, there are attained in the nozzles with pressures between 0.4 to 0.8 atmospheres, air velocities, which set the bath upon exclusion of spraying or ejection into a movement similar to cooking. Thereupon, during maintenance of the separation of metal bath and slag in the reaction vessel during the blasting, in view of an optimum convection flow, high reaction velocities are made possible. Through this convection flow, it is namely attained, that in the metal bath, very rapidly an equalization of concentration takes place through diffusion of the oxygen, and thereupon a local over-oxidation of the copper in the vicinity of the nozzle, which would lead to the formation of a non-soluble cuprous oxide phase, and accordingly to greater copper-sintering, would be prevented to a far-going extent.

After termination of the blasting phase, the following melting products were discharged:

Refined converter copper = 16,678 kg.
Converter slag = 5,800 kg.
Converter dust = 890 kg.
(= 75% lead + tin + zinc)

Analyses

Refined converter copper:
copper = 98.3%
tin = 0.07%
lead = 0.1%
nickel = 0.12%
oxygen = 1.3%

The analysis of the copper refined in the converter amounts after deoxidation to:
copper = 99.4%
tin = 0.07%
lead = 0.1%
nickel = 0.12%
oxygen = 0.2%

From the fore-runner copper, during this converter operation, about 92% were discharged.

An apparatus for carrying out of the method according to the invention, consists in the case of a known converter type, for example of the type of construction: Pearce-Smith or Hoboken, therein, that the reactor has at least two devices arranged spatially superimposed for the injection of reaction gas, preferably blower-nozzles.

A purposeful fitting out of this converter with apparatus according to the invention, consists advantageously therein, that the reactor has two rows of nozzles, which are arranged spatially superimposed, and in respect of the blowing-direction of each row are arranged each in a plane in such manner, that these planes intersect at an angle $\alpha$ of about 5° to about 15°, whereby the section line S extends approximately in the area of the wall of the reactor vessel lying opposite the nozzles.

And finally, one may fit out the apparatus according to the invention, so that blower nozzles, in a manner known per se, possess devices for the admixture of a gaseous, liquid or solid substance, for example, fuel or also oxygen to the carrier gas air or air/steam mixture.

In the following, an apparatus, with which the method according to the invention may be carried out, will be explained in greater detail on the basis of drawings:

In the drawings:

FIG. 3 shows as flow-diagram, the diagram of a fuel-supply- and dosaging-device for these nozzles, while

Figure 1:
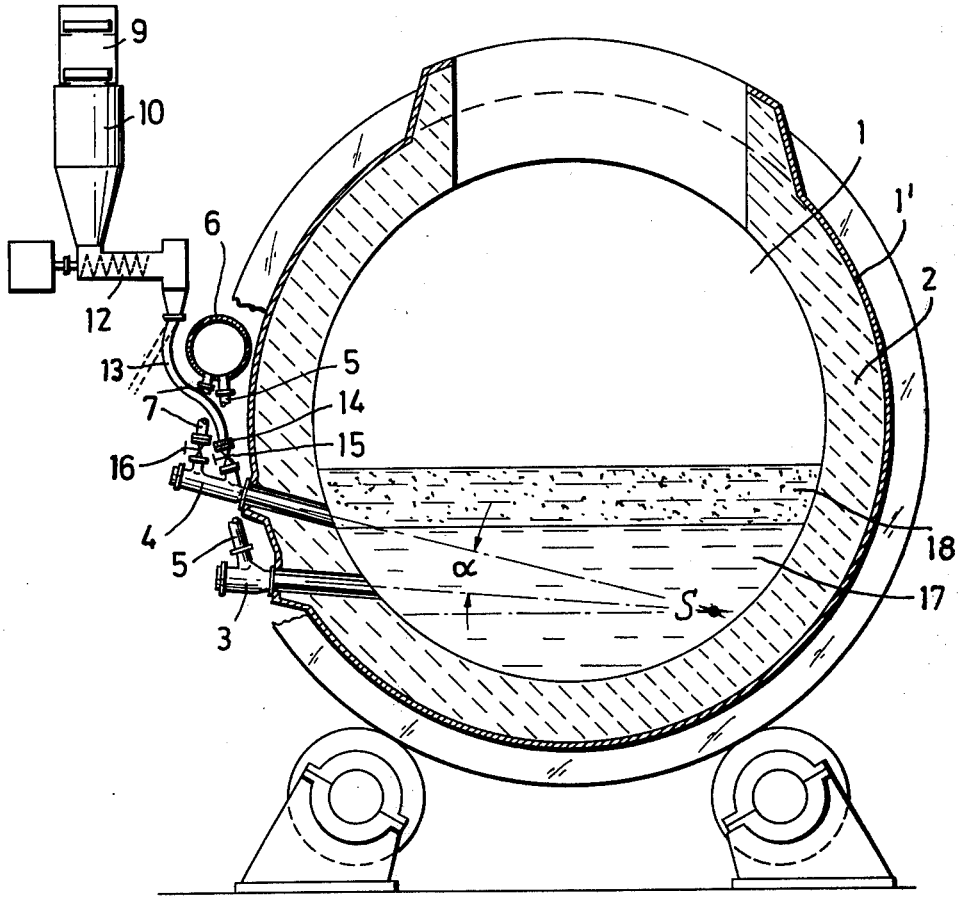
FIG. 1 shows a converter in section, with blower nozzles.
Figure 2:
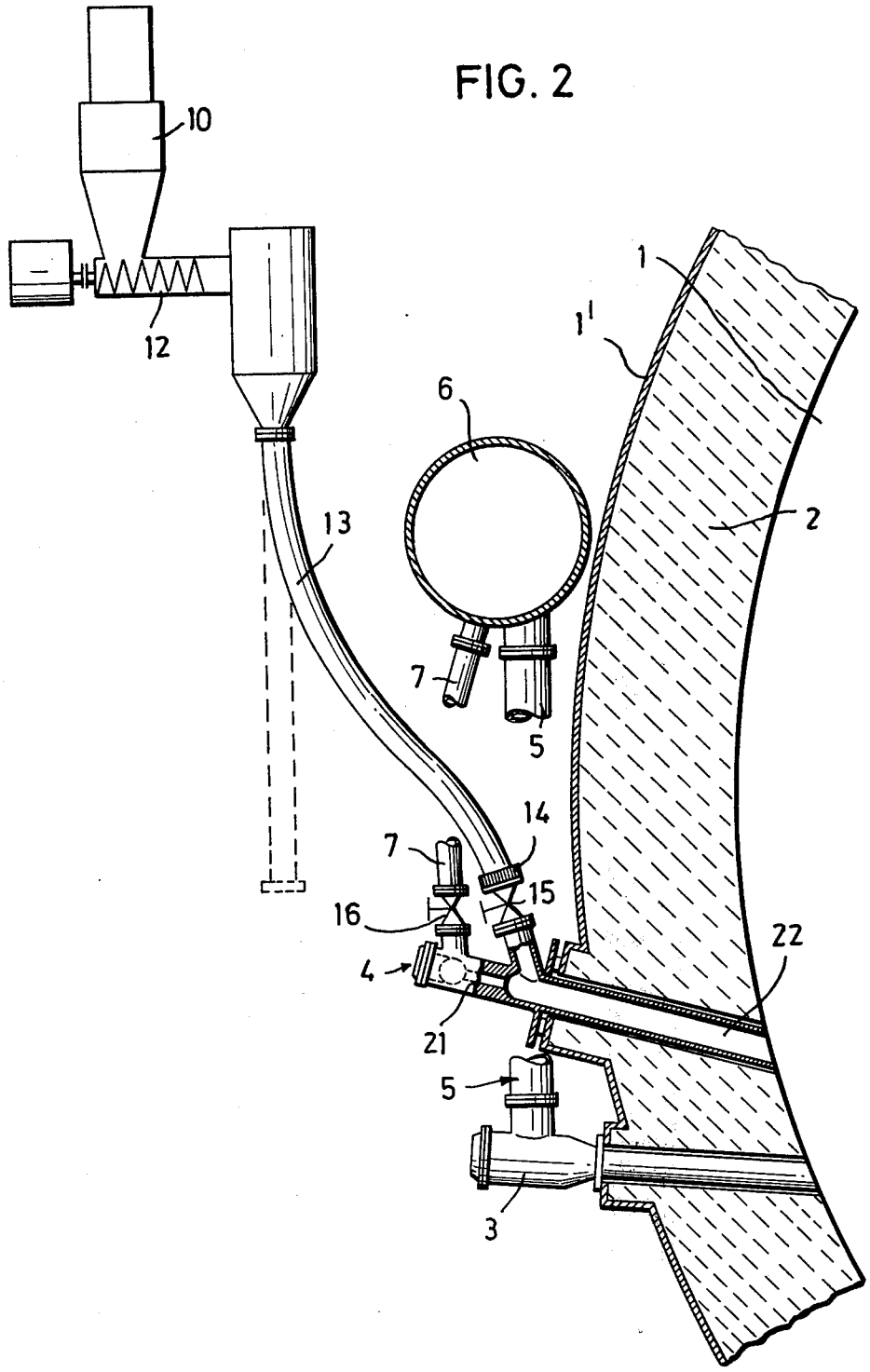
FIG. 2 shows in detail the arrangement of the nozzles on this converter, likewise in section.

In FIG. 1, is seen a converter vessel 1 with a sleeve 1' and the a refractory liner 2.

The oxygen necessary for the conversion operation — during the phase of the iron oxidation and the oxidation of the sulphur bound to iron and copper in form of air — oxygen is conveyed through the nozzles 3 and 4 into the bath 17 consisting of copper-matte or -metal.

The nozzles 3, which are connected through a flexible connection 5 with the air-supply-pipe 6, correspond in their number and arrangement on the reaction vessel 1 with the previous state of the art.

Above the nozzles 3 are arranged additionally further nozzles 4. The latter are connected through likewise flexible connections 7 with the air supply pipe 6 and are accordingly acted on by the same quantity of air as the nozzles 3. The number of the nozzles 3 and 4 is dimensioned in such manner, that the free cross-section of the nozzles 4 and 3 are in a determined ratio, chiefly in the ratio 1 : 6. Geometrically, the nozzles 4 are so arranged on the reaction-vessel 1, that in the first phase of the iron- and sulphur-oxidation, the nozzles 4 likewise blow into the bath 17 of copper-matte or -metal.

In the course of this blowing phase, on account of increasing density of the sulphide-melt upon the conversion of the copper-matte or -metal to refined-garnierite-for-gaining-copper, the bath level of the sulphide melt 17 drops, and there is formed thereon a fayalite-slag 18 with a high proportion of magnetite. The chemical composition of the copper-matte or -metal 17, as well as the quantity of air injected through the nozzles 3 and 4 permit of determining by calculation the point of time at which the nozzles 4 on account of their geometrical arrangement will blow into the slag layer 18 formed.

Figure 3:
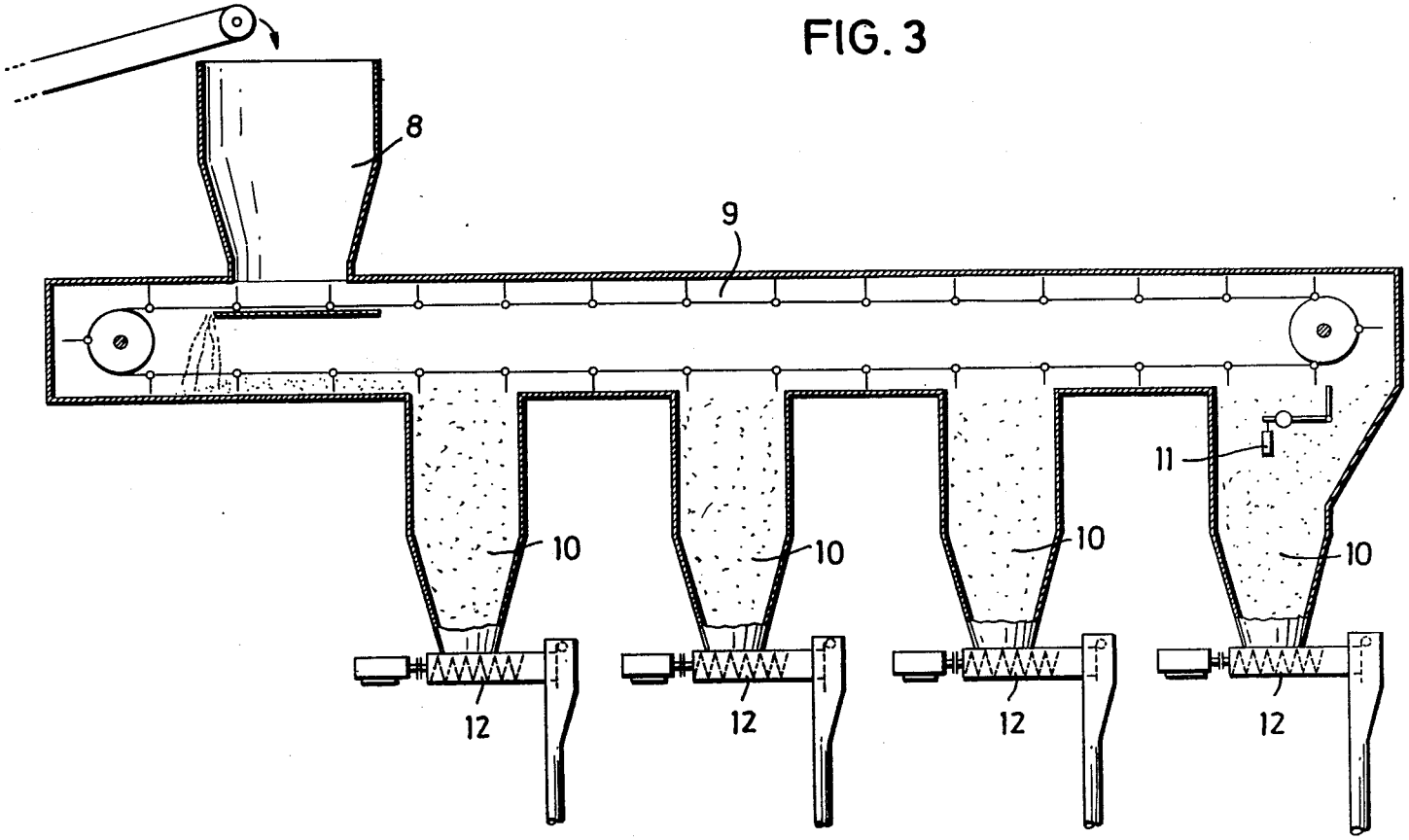

Shortly before this point of time, the blower air of the nozzles 4 has admixed therewith, fine coal. This admixture of coal brings it about that on the one hand, upon entry of the air-coal-mixture into the slag 18, an exothermic combustion operation starts, whereby a cooling off of the slag 18 in the area of the nozzles 4 is prevented, and that on the other hand, in the slag-layer, reducing conditions are furnished, which lead to the reduction of the metal oxides. The addition of the fine coal to the nozzles 4 takes place through the device shown in FIG. 3. From a hopper 8 arranged in the area of the converter platform, coal is drawn off by means of a chain-conveyor 9. According to a number of nozzles not shown in FIG. 3, there is arranged under the chain-conveyor 9 a number of allocation- or feed-hoppers 10, whereby on the last hopper 10 an end- or terminalswitch 11 is installed, which shuts off after filling of this hopper 10, the chain conveyor 9. Further, each of these hoppers 10 is provided with a screw feed 12 of known type of construction, as a meter device. This screw feed 12 makes it possible, upon simultaneous sealing from the nozzle pressure, to distribute the coal in metered quantity to the nozzles 4. The devices 8, 9, 10, 11 and 12 are connected with the reaction vessel 1 solely by means of the flexible tubes 13 (FIGS. 1 and 3), as well as conventional quick-opening members 14 with the nozzle head 21 as well as the nozzle-connection or -stock.

Under the quick-opening member 14 is arranged a valve 15 through which the connection between the flexible tube 13 and the coal-distributor 10, 12 may be separated, when a rotation of the converter 1 requires this. Furthermore, there is installed in the air supply 7 to the nozzle head 21 of the nozzle 4, a valve 16, whereby may be adjusted if necessary a pressure differential between the nozzles 3 and 4, for example upon altering density of the molten phase copper-matte or -metal/-slag, or also a desired action on the nozzles 3, 4.

Figure 4:
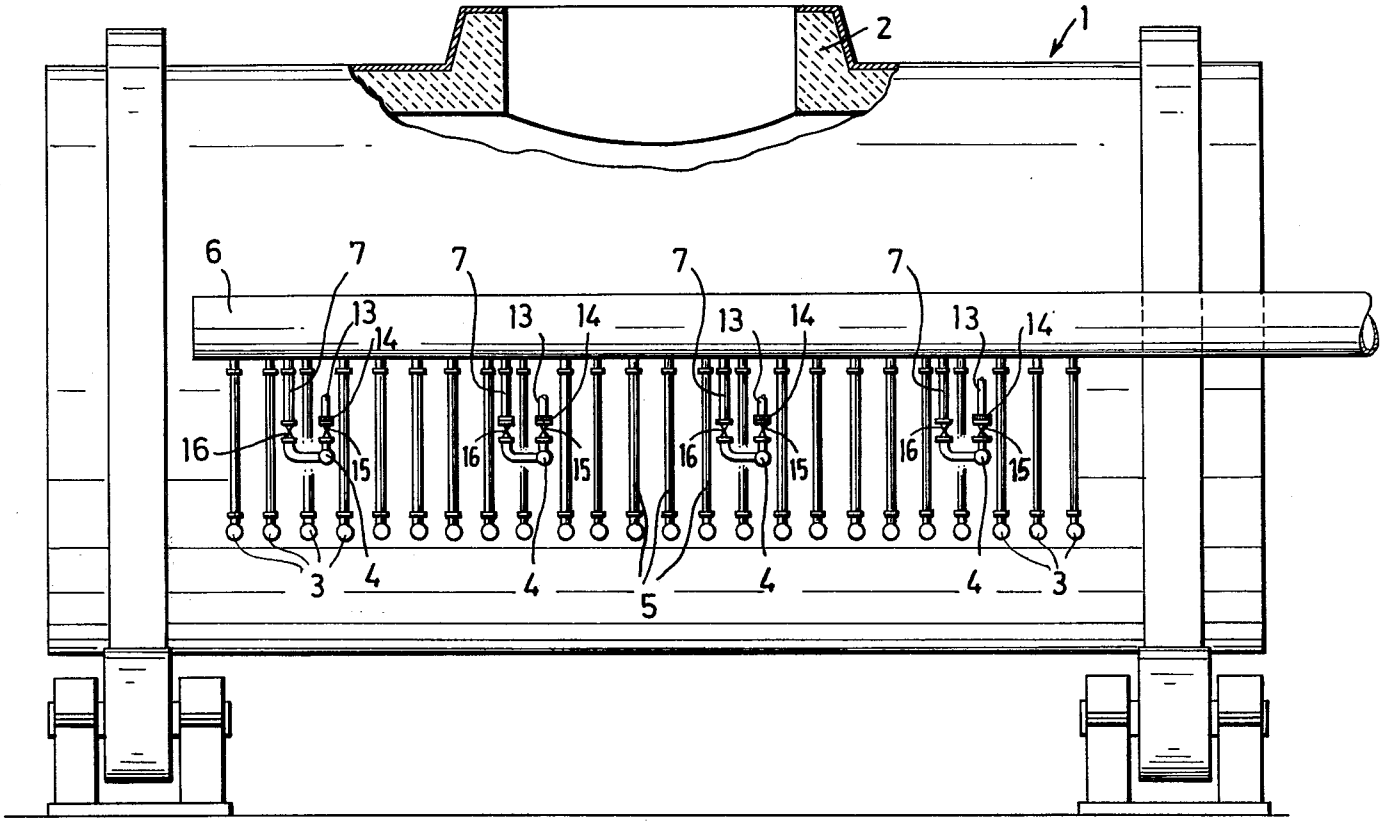
FIG. 4 shows a side view of the converter vessel with two rows of nozzles arranged below one another.

In FIG. 4 is shown the same converter 1 with the refractory 2 in side view. In this connection, is clearly seen the arrangement of the nozzles 3 in a lower row, as well as the nozzles 4 in an upper row. Further, the air-supply-pipe 6 may be seen, from which flexible tubes 5 lead to the row of the lower nozzles 3 and flexible tubes 7 to the row of the upper nozzles 4. From the coal-supply-device not visible in FIG. 4 are likewise disposed flexible tubes 13, shown broken away, to the nozzles 4, and connected through quick-opening members 14 as well as closure-members 15 with the same.

Furthermore, there is seen between the flexible tubes 7 and the nozzles 4, adjusting valves 16. The latter permit altering of the pressure and therewith the density of gas flow of a nozzle 4 with respect to a nozzle 3. From FIG. 4, is above all, however, to be seen also the number of nozzles 3 and 4. The lower row is equipped in the example shown with 6 times as many nozzles 3 as the upper row of nozzles 4. Of course, this arrangement of the invention is shown only by way of example, and may be varied as desired within the limits of the declared claims of the apparatus.

We claim:

1. In a method for the thermal refinement of contaminated copper scrap in the molten phase in which superimposed molten phases are formed in a treating vessel, the lower phase containing black copper and the upper phase containing a slag with impurities such as zinc, tin, lead and the like, the improvement which comprises simultaneously injecting a reducing gas into said upper phase from a plurality of spaced parallel points and an oxidizing gas into said lower phase from a plurality of spaced parallel points, said oxidizing gas being introduced at a rate higher than said reducing gas.

2. A method according to claim 1 in which the relative amounts of reducing gas and oxidizing gas are adjusted to produce an atmosphere at the interface between the two phases such that the relationship between the partial pressure of carbon dioxide [P ($CO_2$)] to the partial pressure of carbon monoxide [P (CO)] is within the following range:

$$\log [P(CO_2)/P(CO)] = 0.3 \text{ to } 4$$

3. A method according to claim 1 in which said reducing gas includes a liquid or solid fuel.

4. A method according to claim 3 in which the mass velocity of the gas fed to the upper phase is about 1/6 the mass velocity of the gas fed to the lower phase.

5. A method according to claim 4 in which one of the gases is injected below the metal-slag interface and the other gas is injected in close proximity to the interface.

6. A method according to claim 5 in which the mass velocity of one of the reactive gases is less than 500 $Nm^3/h$.

* * * * *